US007086114B2

(12) United States Patent
Hirse

(10) Patent No.: US 7,086,114 B2
(45) Date of Patent: Aug. 8, 2006

(54) WET FLOOR WIPING DEVICE

(75) Inventor: Gernot M. Hirse, Frankfurt (DE)

(73) Assignee: Firma Carl Freudenberg, Weinheim (DE)

( * ) Notice: Subject to any disclaimer, the term of this patent is extended or adjusted under 35 U.S.C. 154(b) by 400 days.

(21) Appl. No.: 09/990,074

(22) Filed: Nov. 21, 2001

(65) Prior Publication Data

US 2002/0073498 A1 Jun. 20, 2002

(30) Foreign Application Priority Data

Nov. 24, 2000 (DE) ..... 100 58 510

(51) Int. Cl.
*A47L 13/14* (2006.01)
*A47L 13/146* (2006.01)

(52) U.S. Cl. ..... 15/119.2; 15/119.1; 15/116.2; 15/244.1

(58) Field of Classification Search ..... 15/119.1, 15/119.2, 116.1, 116.2, 244.1, 244.4; D32/44, D32/51

See application file for complete search history.

(56) References Cited

U.S. PATENT DOCUMENTS 2,663,039 A * 12/1953 Bagley, Jr. ..... 15/119.2
3,224,025 A * 12/1965 Altrock ..... 15/119.2
3,271,804 A * 9/1966 Tillinghast ..... 15/119.2
4,893,369 A * 1/1990 Johnson ..... 15/119.2
5,483,720 A * 1/1996 Decoopman et al. ..... 15/119.2
5,625,918 A * 5/1997 Kieson et al. ..... 15/119.2
5,896,613 A * 4/1999 Courtney et al. ..... 15/119.2

FOREIGN PATENT DOCUMENTS

DE 42 22 948 2/1993
WO 98/06316 2/1998

* cited by examiner

*Primary Examiner*—Robert J. Warden, Sr.
*Assistant Examiner*—Laura C Cole
(74) *Attorney, Agent, or Firm*—Kenyon & Kenyon

(57) ABSTRACT

A wet floor wiping device includes a mop made of absorbent material and a mop frame exhibiting a center carrier piece (4) attached to a handle (3). Mounted pivotably at each hinge edge (5) at the center carrier piece (4) are two mop carrier wings (6), the inner surfaces of which, carrying the mop, can be pressed one against another by means of a squeeze feature. At least one of the two side edges (8, 9) extending from the hinge edge (5) is angled in relationship to the opposite side edge (9). Each mop carrier wing (6) forms a trapezoid including a right angle, the longer base line of which is the hinge edge (5).

7 Claims, 1 Drawing Sheet

WET FLOOR WIPING DEVICE

BACKGROUND OF THE INVENTION

1. Field of the Invention

The invention pertains to a wet floor wiping device comprising a mop made of absorbent material and a mop frame exhibiting a center carrier piece which is attached to a handle and to which two mop head wings are pivotably mounted by way of a hinge edge so that by way of a squeezing feature the two interior surfaces carrying the mop can be pressed one against the other.

2. Description of Related Art

When in their working position wet floor wiping devices of this type, which because of their two pivoted wings are also known as "butterfly mops," form a flat mop carrier surface comprising the two mop carrier wings and the center carrier piece which joins them and to which a mop made of absorbent material is attached.

In this flat and level arrangement the mop can be passed over the floor surface to be cleaned, in full contact with the surface, whereby it picks up grime. Then the mop is again rinsed and squeezed out. To do so it is first necessary to submerge it, with the mop carrier wings swung downward from the center carrier piece, into a cleaning bucket containing cleaning water. Then the two mop carrier wings with their interior surfaces carrying the mop are pressed one against the other by way of a squeezing device, this in order to remove excess cleaning water from the mop before it is once again swung outward and placed on the floor surface to be cleaned.

In this flat and level arrangement the mop can be passed over the floor surface to be cleaned, in full contact with the surface, whereby it picks up grime. Then the mop is again rinsed and squeezed out, To do so it is first necessary to submerge it, with the mop carrier wings swung downward from the center carrier piece, into a cleaning bucket containing cleaning water. Then the two mop carrier wings with their interior surfaces carrying the mop are pressed one against the other by way of a squeezing device, this in order to remove excess cleaning water from the mop before it is once again swung outward and placed on the floor surface to be cleaned. cleaned.

The squeezing feature may, for example, comprise a lever mechanism which attached to the wet floor wiping device and which is actuated by hand in order to apply the required squeezing force. In all the known wet floor wiping devices of this kind (DE 42 22 948 A1) the mop carrier wings are rectangular in shape. The depth of the water in the cleaning bucket required to rinse the mop will have to be selected at a minimum so that the rectangular mop carrier wings which, for ergonomic reasons, are normally inserted into the cleaning bucket at an angle, are completely submerged in water. With rectangular mop carrier wings this minimum depth of the cleaning water is relatively great so that a relatively large quantity of water will have to be made available in the cleaning bucket, in turn rendering the cleaning bucket heavy.

The maximum force required to squeeze out the mop is determined essentially by the slewing moment required to swing the mop carrier wings at the end of their slewing motion. Here the surface areas which are the most distant from the pivot axis make the greatest contribution to squeezing moment since these most distant surface areas have the longest lever arms. Consequently it is necessary to provide a lever amplification feature in order to be able to apply the required squeezing moment at the end of the squeezing motion.

SUMMARY OF THE INVENTION

It is an object of the invention to provide a wet floor wiping device of the general type described above which can make do with a lower cleaning water depth and a reduced maximum squeezing moment.

These and other objects of the invention are achieved by a wet floor wiping device with a mop made of absorbent material and a mop frame exhibiting a center carrier piece attached to a handle and to which two mop carrier wings are pivotably mounted with a hinge edge, the inner surfaces of which carry the mop and can be pressed one against another by way of a squeezing feature, wherein at least one (8) of the two side edges (8, 9) extending from the hinge edge (5) is sloped toward the other side edge (9).

BRIEF DESCRIPTION OF THE DRAWINGS

The present invention will be described in greater detail with reference to the following drawings wherein.

DETAILED DESCRIPTION OF THE INVENTION

Figure 1:
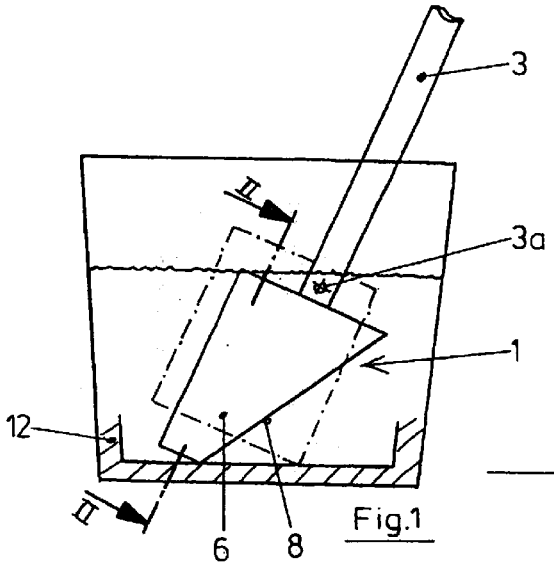
FIG. 1 shows a radically simplified depiction a side view of a wet floor wiping device which is submerged in a cleaning bucket.

Each mop carrier wing is thus wider at the edge adjoining its hinge edge than at the edge opposite the hinge edge. When compared with a rectangular mop carrier wing, its width is thus reduced and thus also its surface area is reduced with increasing distance from the pivoting axis at the hinge edge. Consequently those surface areas with the longest lever arms are reduced in size. In this way the required maximum squeezing momentum is also reduced so that the mop can be squeezed out with less force. Consequently working with the wet floor wiping device is less strenuous, The sloped arrangement of the one side edge and thus the deviation from a rectangular surface at the mop carrier wing results in a lower water level being required to submerge the mop completely in the cleaning water. Where the mop exhibits the same overall surface area its submersion depth at the angled submersion attitude of the wet floor wiping device normally adopted for ergonomic reasons will be reduced. At the same water depth there is a broader cleaning swath at the same force application.

The reduced width at the outboard ends of the two mop carrier wings also makes it easier to insert the mop into confined corners and openings so that a more thorough cleaning effect is achieved even in those areas of the floor surface to be cleaned which are difficult to access. This makes it easier to work around hindrances on the floor.

Each mop carrier wing will preferably form a trapezoid including one right angle, the longer base line of which forms the hinge edge. In its extended position on the floor the mop thus has a continuous leading edge made up of the two right-angled side edges and two narrower ends which could ultimately become a corner so that each mop carrier wing forms a triangle.

In accordance with a preferred embodiment the inside surface of each mop carrier wing exhibits drain grooves which run toward the angled side edge. Thus water drainage to the angled side edge during the squeezing procedure is improved. Here it is particularly advantageous if the water drain grooves, arranged parallel one to another, for example, are positioned at an angle to the hinge edge. With this arrangement the water drain grooves are then, at the usual angled attitude for the wet floor wiping device adopted during the squeezing procedure, nearly aligned with the vertical-so that the water can flow downward unhindered. Water drainage can be further facilitated ff the water drain grooves are made wider toward the angled side edge. Thus the share of the surface occupied by the grooves is greater in the areas distant from the pivot axis and consequently the required pressure is lower.

Overall handling of the wet floor wiping device is improved ergonomically. Lifting and carrying the cleaning bucket is facilitated because a lower water depth and thus reduced water quantity can be selected. The force applied during squeezing is reduced because the surface areas distant from the pivot axis are reduced.

Figure 3:
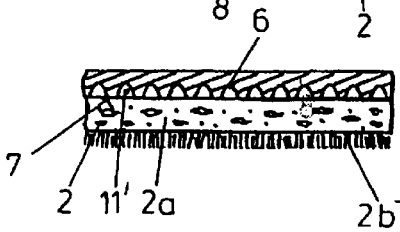
FIG. 3 shows an enlarged section along plane III—III in FIG. 2.

A preferred embodiment of the invention is illustrated in the drawings. Wet floor wiping device 1 depicted in the drawings exhibits a mop 2 made of absorbent material consisting, for example, of a sponge layer 2*a* and a napped mop 2*b* (FIG. 3). A handle 3 is preferably attached to a center carrier piece 4 by way of a joint 3*a*, to which one mop carrier wing 6 is pivotably mounted at the hinge edge 5 in each case (FIG. 2).

The interior surfaces 7 of the two mop carrier wings 6 and the interior surface 13 of the center carrier piece 5 form the surface to which the mop 2 is attached.

Figure 2:
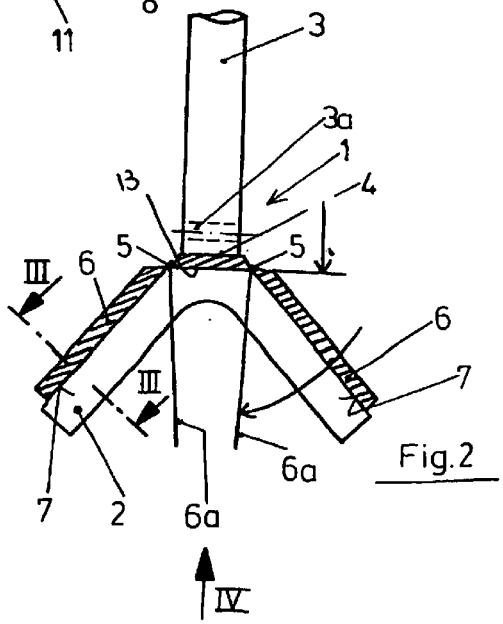
FIG. 2 shows a simplified section along plane II—II in FIG. 1.

As is suggested in FIG. 2, the two mop carrier wings 6 can be pivoted against each other using a squeezing feature (not illustrated) so that the mop 2 located between them is squeezed out. The normal final squeezing position for the mop carrier wings 6 is suggested in FIG. 2 by lines 6*a*.

Each of the two mop carrier wings 6 forms a trapezoid including a right angle. The longer base line of the trapezoid forms the hinge edge 5 in each case. One side edge 8 of each mop carrier wing 6 runs at an acute angle to the hinge edge 5 and is slanted in regard to the other side edge 9, which in the embodiment illustrated runs a right angle to the hinge edge 5.

The free edge 10 of each mop carrier wing 6 opposite the hinge edge 5 thus forms the shorter base line of the trapezoid. Each mop carrier wing 6 is considerably smaller in the area near its free edge 10 than in the area near its hinge edge 5. The free edge 10 can be reduced down to the point of forming an angle. With a moderate increase in the required pressure there results in this way a further considerable increase in the wiping swath without increasing the submersion depth.

Water drain grooves 11 are provided on the inside surface 7 of each mop carrier wing 6, these being arranged parallel one to the other and running toward the sloped side edge 8. In the embodiment illustrated here the water drain grooves 11 run at an angle of about 60° to 80°, and preferably 70° to the hinge edge 5. The angled side edge 8 runs at an angle of about 50° to 70° and preferably 60°, to the hinge edge 5.

In comparison to a wet floor wiping device with rectangular mop carrier wings, which are suggested by dot-and-dash lines, and which exhibits the same surface area as the trapezoidal mop carrier wings 6 shown, the wet floor wiping device illustrated with a sloped side edge 8 can make do with a water of a lesser depth in the cleaning bucket 12. The submersion depth of the wet floor wiping device, at the normal angled attitude illustrated, is less than that for rectangular mop carrier wings 6.

Figure 4:
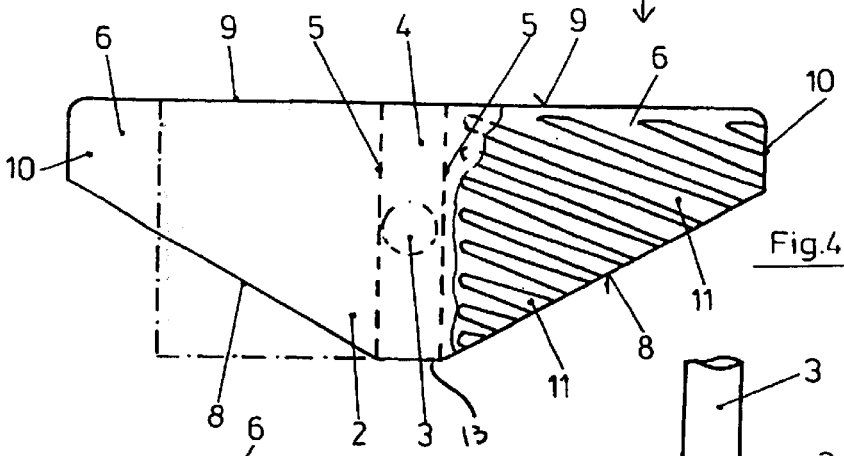
FIG. 4 shows a bottom view of the wet floor wiping device seen in the direction of the arrow IV indicated in FIG. 2, in the fully extended state, where the mop has been omitted in part in the interest of a clearer depiction.

Indicated in FIG. 4, again with dot-and-dash lines, is a rectangular mop carrier wing exhibiting the same surface area as the trapezoidal mop carrier wing 6 shown.

Figure 5:
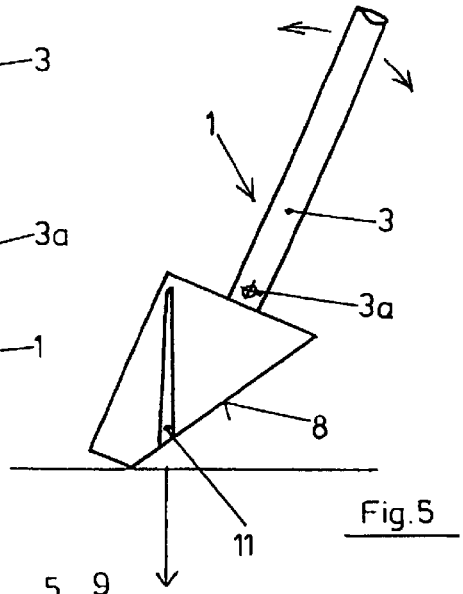
FIG. 5 shows a schematic side view of the wet floor wiping device during the squeezing procedure.

The orientation of the water drain grooves 11 as described causes these water drain grooves 11 to run nearly vertical in the usual angled attitude of the wet floor wiping device (FIG. 5) adopted for ergonomic reasons during the squeezing procedure so that the cleaning water extracted can run downward. Water drainage is further improved by the widening cross-sectional shape of the water drain grooves.

What is claimed is:

1. A wet floor wiping device comprising: a mop made of absorbent material; a mop frame including a center carrier piece attached to a handle; and two quadrilateral shaped mop carrier wings, each wing pivotably mounted by a hinge edge of the center carrier piece, the carrier wings having inner surfaces which carry the mop and which can be pressed against each other by way of squeezing, wherein at least one of two side edges extending from the hinge edge is slanted toward the opposite side edge, and wherein the carrier wings include water drain grooves which run transverse to a perpendicular of the hinge edge toward the slanted side edge.

2. The wet floor wiping device according to claim 1, wherein each mop carrier wing forms a trapezoid with an included right angle, the larger base line of which forms the hinge edge.

3. The wet floor wiping device according to claim 1, wherein the water drain grooves are arranged parallel one to another.

4. The wet floor wiping device according to claim 3, wherein the mop carrier wings have an interior surface and wherein the water drain grooves extend between the interior surface and a point between the interior surface and an opposite mop carrier wing surface.

5. The wet floor wiping device according to claim 1, wherein the water drain grooves become wider toward the angled side edge.

6. A wet floor wiping device comprising: a mop made of absorbent material; a mop frame including a center piece attached to a handle; and two mop carrier wings, each wing pivotably mounted by a hinge edge of the center carrier piece, the carrier wings having inner surfaces which carry the mop and which can be pressed against each other by way of squeezing, wherein at least one of two side edges extending from the hinge edge is slanted toward the opposite side edge, wherein each mop carrier wing has an interior surface having water drain grooves which run toward the slanted side edge, and wherein the water drain grooves become wider toward the angled side edge.

7. The wet floor moping device according to claim 6, wherein the water drain grooves run transverse to a perpendicular of the hinge edge towards the slanted side edge.

* * * * *